US007274136B2

(12) United States Patent
DiSanto et al.

(10) Patent No.: US 7,274,136 B2
(45) Date of Patent: Sep. 25, 2007

(54) HYBRID ACTIVE MATRIX THIN-FILM TRANSISTOR DISPLAY

(75) Inventors: Frank J. DiSanto, Manhasset, NY (US); Denis A. Krusos, Llyod Harbor, NY (US); Segey L. Shokhor, E. Setavket, NY (US); Alexander Kastalsky, Wayside, NJ (US)

(73) Assignee: Copytele, Inc., Melville, NY (US)

( * ) Notice: Subject to any disclaimer, the term of this patent is extended or adjusted under 35 U.S.C. 154(b) by 0 days.

(21) Appl. No.: 10/782,580

(22) Filed: Feb. 19, 2004

(65) Prior Publication Data

US 2005/0162064 A1 Jul. 28, 2005

Related U.S. Application Data

(63) Continuation-in-part of application No. 10/763,030, filed on Jan. 22, 2004, now abandoned.

(51) Int. Cl.
*H01J 1/304* (2006.01)

(52) U.S. Cl. ..... 313/495; 313/496; 313/497

(58) Field of Classification Search ..... 313/495–497, 313/309, 310; 315/169.1; 345/75.2
See application file for complete search history.

(56) References Cited

U.S. PATENT DOCUMENTS 3,755,704 A 8/1973 Spindt
5,177,406 A * 1/1993 Troxell ..... 315/169.1
5,214,347 A 5/1993 Gray
5,345,141 A 9/1994 Moyer
5,541,478 A * 7/1996 Troxell et al. ..... 313/497
5,736,814 A * 4/1998 Kinoshita et al. ..... 313/495
5,955,850 A 9/1999 Yamaguchi et al.
6,023,126 A 2/2000 Karpov
6,590,320 B1 7/2003 Abanshin et al.
6,614,149 B2 9/2003 Kastalsky
6,674,242 B2 1/2004 Kastalsky
2002/0030646 A1* 3/2002 Song et al. ..... 345/75.2
2002/0134978 A1 9/2002 Kastalsky
2003/0090190 A1 5/2003 Takai
2004/0058153 A1 3/2004 Ren et al.
2004/0222734 A1* 11/2004 Oh ..... 313/497

OTHER PUBLICATIONS

"Nano SU-8 Negative Tone Photoresist Formulations 2-25", Micro Chem, 4 pages, Rev. Feb. 2002.

(Continued)

*Primary Examiner*—Nimeshkumar D. Patel
*Assistant Examiner*—Matt Hodges
(74) *Attorney, Agent, or Firm*—Plevy, Howard & Darcy, PC

(57) ABSTRACT

A cold-cathode flat panel display using thin-film-transistor (TFT) anode circuit is disclosed. Associated with each pixel element is a TFT circuit comprising first and second transistors electrically cascaded and a capacitor in communication with an output of the first device and an input of the second transistor used to selectively address pixel elements in the display and hold pixels in their selected states for the frame time. Cold cathode sources are used to emit electrons that are drawn to selected pixel elements that include phosphor areas, which emit light of a known wavelength when struck by the emitted electrons.

38 Claims, 10 Drawing Sheets

OTHER PUBLICATIONS

K.B.K. Teo et al., "Uniform Patterned Growth of Carbon Nanotubes Without Surface Carbon", Applied Physics Letters, vol. 79, No. 10, pp. 1534-1536, Sep. 3, 2001.

C.J. Spindt et al., "9.2: ThinCRT Flat-Panel-Display Construction and Operating Characteristics", SID-98 DIGEST, pp. 99-102, 1998.

C.A. Spindt, "A Thin-Film Field-Emission Cathode", Journal of Applied Physics, vol. 39, No. 7, pp. 3504-3505, Jun. 1968.

Shoushan Fan et al., "Self-Oriented Regular Arrays of Carbon Nanotubes and Their Field Emission Properties", Science Magazine, vol. 283, pp. 512-514, Jan. 22, 1999.

Jaemyung Kim et al., "Growth and Field Emission of Carbon Nanotubes on Electroplated Ni Catalyst Coated on Glass Substrates", Journal of Applied Physics, vol. 90, No. 5, pp. 2591-2594, Sep. 1, 2001.

Z. F. Ren et al., "Growth, Characterization, and Potential Applications of Periodic Carbon Nanotube Arrays", 2 pages.

Bingqing Wei et al., "Lift-Up Growth of Aligned Carbon Nanotube Patterns", Applied Physics Letters, vol. 77, No. 19, pp. 2985-2987, Nov. 6, 2000.

* cited by examiner

HYBRID ACTIVE MATRIX THIN-FILM TRANSISTOR DISPLAY

CLAIM OF PRIORITY

This application is, pursuant to 35 USC § 120, a continuation-in-part of:

U.S. patent application Ser. No. 10/763,030, entitled "Hybrid Active Matrix Thin-Film Transistor Display," filed on Jan. 22, 2004now abandoned, the contents of which are incorporated by reference herein.

RELATED APPLICATIONS

This application is related to commonly-assigned, co-pending:

U.S. patent application Ser. No. 10/102,472, entitled "Pixel Structure for an Edge-Emitter Field-Emission Display," filed Mar. 20, 2002, the contents of which are incorporated by reference herein.

FIELD OF THE INVENTION

This application is related to the field of vacuum displays and more specifically to flat panel displays using Thin Film Transistor (TFT) technology.

BACKGROUND OF THE INVENTION

Flat panel display (FPD) technology is one of the fastest growing technologies in the world with a potential to surpass and replace Cathode Ray Tubes (CRTs) in the foreseeable future. As a result of this growth, a large variety of the FPDs, ranging from very small virtual reality eye tools to large TV-on-the-wall displays, will soon become available. Thin displays will operate with digital signal processing that affords high-definition screen resolution.

Some of the more important requirements of FPDs are video rate of the signal processing; resolution typically above 100 DPI (dots per inch); color; contrast ratios greater than 20; flat panel geometry; screen brightness above 100 candles/meter squared (cd/m$^2$); and large viewing angle.

At present, liquid crystal displays (LCD) dominate the FPD market. However, although significant technological progress has been made in recent years, LCDs still have some drawbacks and limitations that pose considerable restraints. First, LCD technology is rather complex, which results in a high manufacturing cost and price of the product. Other deficiencies, such as small viewing angle, low brightness and relatively narrow temperature range of operation, make application of the LCDs difficult in many high market value areas such as car navigation devices, car computers, and mini-displays for cellular phones.

Other FPD technologies capable of competing with the LCDs are currently under investigation. Among these technologies, plasma displays and field-emission displays (FED) are considered to be the most promising. Plasma displays employ a plasma discharge in each pixel to produce light. One limitation associated with plasma displays is that the pixel cells for plasma discharge cannot be made very small without affecting neighboring pixel cells. This is why the resolution in plasma FPD is poor for small format displays and becomes more efficient as the display size increases above 30" diagonally. Another limitation associated with plasma displays is that they tend to be thick as compared to FPDs. A typical plasma display has a thickness of about 4 inches.

Field Emission Displays (FEDs), on the other hand, employ "cold cathodes" which produce mini-electron beams that activate phosphor layers in the pixel. It has been predicted that FEDs will replace LCDs in the future. Currently, many companies are involved in FED development. However, after ten years of effort FEDs are not yet in the market.

FED mass production has been delayed for several reasons. One of these reasons concerns the fabrication of the electron emitters. The traditional emitter fabrication is based on forming multiple metal (Molybdenum) tips, see C. A. Spindt "Thin-film Field Emission Cathode," Journal. Of Appl. Phys., v. 39, 3504, and U.S. Pat. No. 3,755,704 issued to C. A. Spindt. The metal tips concentrate an electric field, activating a field-induced auto-electron emission to a positively biased anode. The anode contains light emitting phosphors which produce an image when struck by an emitted electron. The technology for fabricating the metal tips, together with necessary controlling gates, is rather complex. This fabrication process requires a sub-micron, electron-beam lithography and angled metal deposition in a large base electron-beam evaporator.

Another difficulty associated with FED mass production relates to the lifetime of FEDs. Electrons striking the phosphors result in phosphor molecule dissociation and formation of gases, such as sulfur oxide and oxygen, in the vacuum chamber. The gas molecules reaching the tips cloud or shield the electric field resulting in a reduction of the efficiency of electron emission from the tips. A second group of gases, produced by electron bombardment, contaminates the phosphor surface and forms undesirable energy band bending at the phosphor surface. This prevents electron-hole diffusion from the surface into the depth of the phosphor grain resulting in a reduction of the light radiation component of electron-hole recombination from the phosphor. These gas formation processes are interrelated and directly connected with vacuum degradation in the display chamber.

The gas formation processes are most active in the intermediate anode voltage range of 200–1000V. If, however, the voltage is elevated to 6–10 kV, the incoming electrons penetrate deeply into the phosphor grain. In this case, the products of phosphor dissociation are sealed inside the grain and cannot escape into the vacuum. This significantly increases the life time of the FED and makes it close to that of a conventional cathode ray tube.

The high anode voltage approach is currently accepted by all FED developers. This, however, creates another problem. To apply such a high voltage, the anode must be made on a separate substrate and removed from the emitter a significant distance equaling about 1 mm. Under these conditions, the gate controlling efficiency decreases, and pixel cross-talk becomes a noticeable factor. To prevent this effect, an additional electron beam focusing grid is introduced between the first grid and the anode, see, e.g., C. J. Spindt, et al., "Thin CRT Flat-Panel-Display Construction and Operating Characteristics," SID-98 Digest, p. 99, which further complicates display fabrication.

Some existing tip-based FEDs include an additional electron beam focusing grid. Such FEDs include an anode, a cathode having a plurality of metal tip-like emitters, and a control gate made as a film with small holes above the tips of the emitters. The emitter tips produce mini-electron beams that activate phosphors coated on the anode. The phosphors are coated with a thin film of aluminum. The metal tip-like emitters and holes in the controlling gate, which are less than 1 μm in diameter, are expensive and time consuming to manufacture, hence they are not readily suited for mass production.

Another approach to FED emitter fabrication involves forming the emitter in the shape of a sharp edge to concentrate the electric field. See U.S. Pat. No. 5,214,347 entitled "Layered Thin-Edge Field Emitter Device" issued to H. F. Gray. The emitter described in this patent is a three-terminal device for operation at 200V and above. The emitter employs a metal film, the edge of which operates as an emitter. The anode electrode is fabricated on the same substrate, and is oriented normally to the substrate plane, making it unsuitable for display functions. A remote anode electrode is provided parallel to the substrate, making it suitable for display purposes. The anode electrode, however, requires a second plate which significantly complicates the fabrication of the display.

Still another approach to FED emitter fabrication can be found in U.S. Pat. No. 5,345,141, entitled "Single Substrate Vacuum Fluorescent Display," issued to C. D. Moyer, et al., which relates to the edge-emitting FED. The pixel structures described in U.S. Pat. No. 5,345,141 include a diamond film deposited on top of a metal film and only the diamond edge is exposed. Thus, only a relatively small fringing electric field coming from the metal film underneath the diamond film contributes to the field emission process.

Another limitation of FEDs is that the emitter films, including the diamond film and the insulator film, are grown on a phosphor film. The phosphor film is known to have a very rough surface morphology that makes it unsuitable for any further film deposition.

A pixel structure that reduces some of the noted problems with current FED technology is disclosed in commonly-assigned, co-pending, U.S. patent application Ser. No. 10/102,472, entitled "Pixel Structure for an Edge-Emitter Field-Emission Display," filed Mar. 20, 2002. This application depicts an FED pixel that eliminates emitter tips in the FED cathode. In this application, electrons are emitted from the edges of electron emitting materials, such as alpha-carbon.

Although the pixel structure disclosed in the above-noted co-pending application reduces some of the problems, there is a need for a FED pixel design which substantially eliminates the problems associated with FED fabrication and allows for mass production of same.

SUMMARY OF THE INVENTION

A cold-cathode vacuum flat panel display using thin-film-transistor (TFT) circuit is disclosed. Associated with each pixel element is a TFT circuit comprising a first and second active devices electrically cascaded and a capacitor in communication with an output of the first device and an output of the second device that may be used to selectively address pixel elements in the display. Cold cathode sources are used to emit electrons that are drawn to selected pixel elements that include phosphor pads, which emit light of a known wavelength when struck by the emitted electrons.

Figure 1:
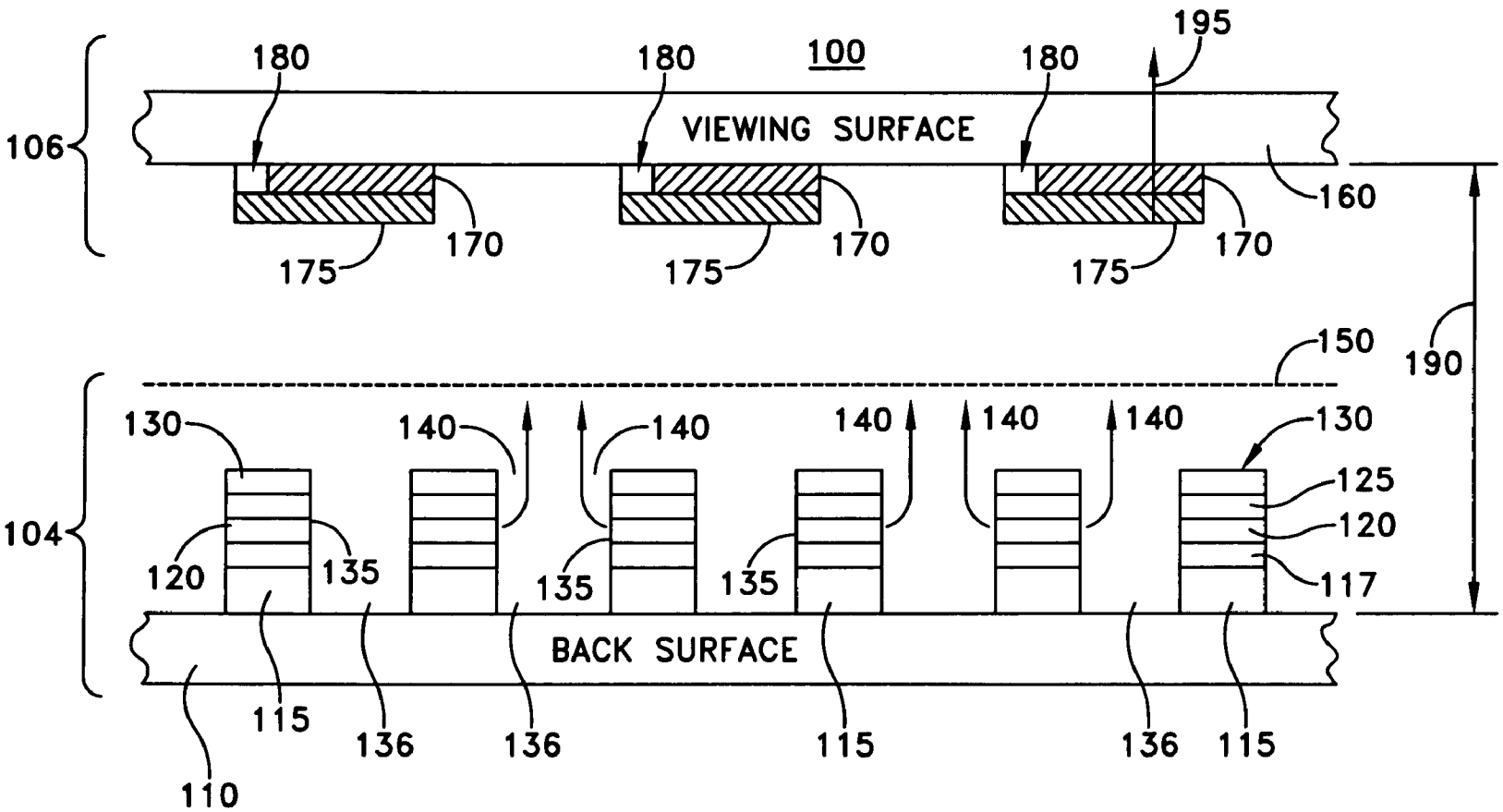
FIG. 1 illustrates a cross-sectional view of a TFT anode-based Field Emission Display (FED) in accordance with the principles of the invention.

It is to be understood that these drawings are solely for purposes of illustrating the concepts of the invention and are not drawn to scale. The embodiments shown herein and described in the accompanying detailed description are to be used as illustrative embodiments and should not be construed as the only manner of practicing the invention. Also, the same reference numerals, possibly supplemented with reference characters where appropriate, have been used to identify similar elements.

DETAILED DESCRIPTION

FIG. 1 illustrates a cross-sectional view of a TFT anode/cold cathode Field Emission Display (FED) element 100 in accordance with the principles of the present invention. In this exemplary embodiment, the display element 100 is composed of cathode 104 that acts as a low-voltage source of electrons, anode 106 that employs TFT technology to control the attraction of electrons 140 to corresponding pixel elements on the surface 160, and grid 150 between anode 106 and cathode 104 that serves to accelerate electrons to the anode 106.

Cathode 104 is fabricated by progressively depositing onto substrate 110, conventionally a glass, an insulating material 115, a conductive material 117, an emitter material 120 operable to emit electrons, a second insulating layer 125, such as $SiO_2$, and a second conductive material 130. Emitter material 120 is selected from known materials that have a low work function for emitting electrons 140. Alpha-carbon is a well-known material for emitting electrons 140. The conductive material 117 beneath the emitter material 120 serves to reduce the resistance of the emitting layer and thus bring the emitter voltage to the edge 135 of emitter material 120. Wells 136 are then etched through the deposited second conductive layer 130, insulating layer 125, emitter layer 120, conductive layer 117 and insulating layer 115 using well-known photoetching methods. In this case, edges 135 of the emitter material 120 are exposed for the generation of electrons 140. Second conductive material 130 operates as a gate to draw electrons 140 from the edges 135 of emitter material 120 when a sufficient potential difference, i.e., electron extraction voltage or threshold voltage, exists between conductive material 130 and conductive layer 117.

Anode 106 is composed of a plurality of conductive pads 170 fabricated in a matrix of substantially parallel rows and columns on surface 160 using known fabrication methods. In this illustrated embodiment material 160 is a transparent material such as glass. Conductive pads 170 are also composed of a transparent material, such as ITO (Indium Titanium Oxide).

Figure 2:
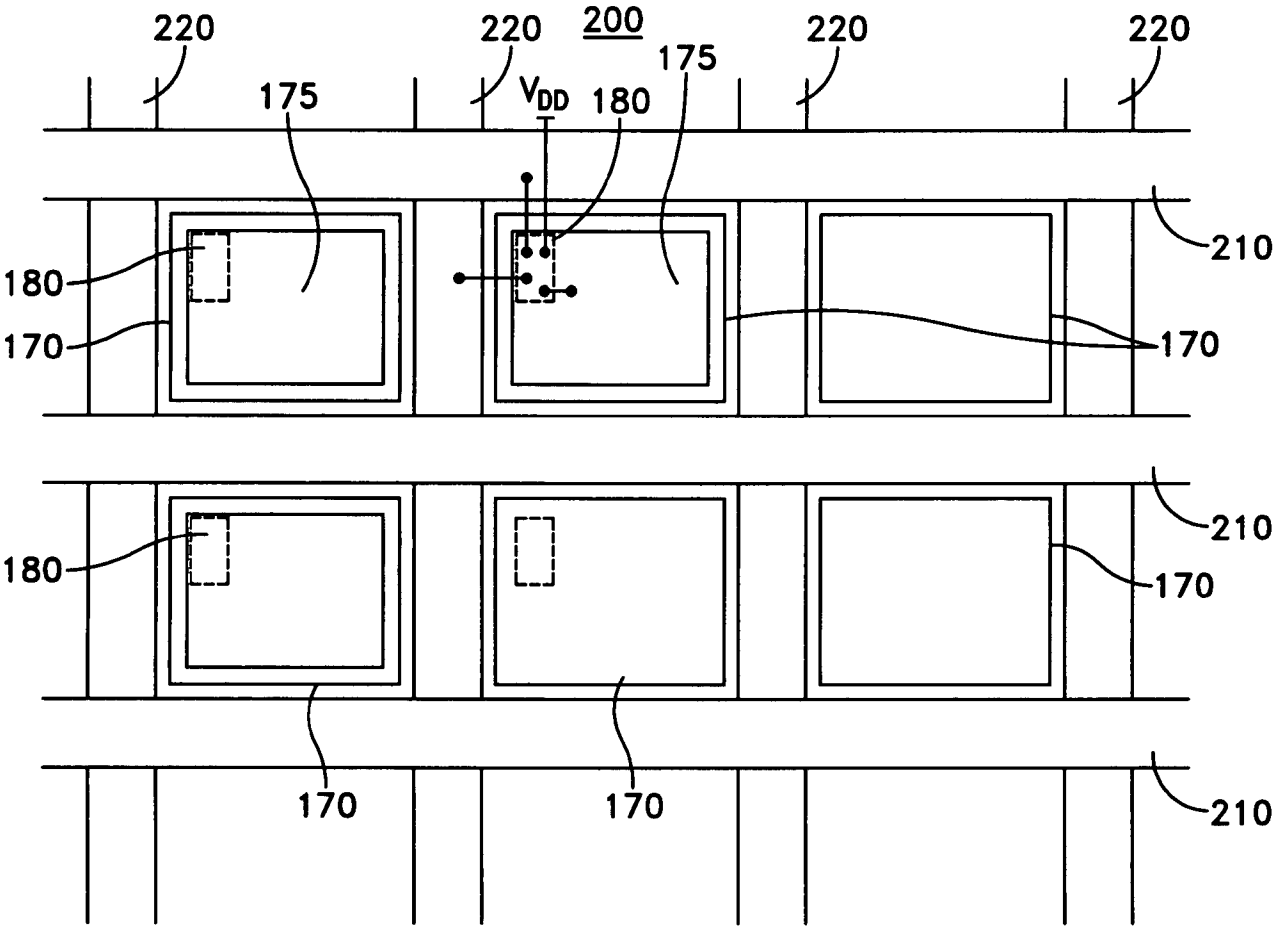
FIG. 2 illustrates a top view of an embodiment of a TFT anode used in the present invention.

A matrix organization, as will be shown in FIG. 2, of conductive pads 170 and phosphor layers 175 allows for known X-Y addressing of each of the conductive pads 170. In this case, conductive pad 170 may be representative of individual pixel element in the display.

Deposited on each conductive pad 170 is phosphor layer 175. Phosphor layer 175, in one aspect of the invention, may be selected from materials that emit photons 195 of a specific color for a monochrome display. In a conventional RGB display, phosphor layer 175 may be selected from materials that produce red light, green light or blue light 195 when struck by electrons 140. As would be appreciated by those skilled in the art, the terms "light" and "photon" are synonymous and are used interchangeably herein.

Associated with each conductive pad 170/phosphor layer 175 pixel element is a TFT circuit 180 that is operable to apply a known voltage to an associated conductive pad 170/phosphor layer 175 pixel element. TFT circuit 180 operates to apply either a first voltage to bias an associated pixel element to maintain it in an "off" state or a second voltage to bias an associated pixel element to maintain it in an "on" state, i.e., activate. In one embodiment, TFT circuit 180 may apply a zero voltage, Va=0, to bias conductive pad 170 into an "off" state, or apply a higher positive bias voltage, in the order of Va=25–30 volts, to bias conductive pad 170 into an "on" state. In this illustrated case, conductive pad 170 is inhibited from attracting electrons 140 emitted by cathode 104 when in an "off" state, and attracts electrons 140 when in an "on" state.

The use of TFT circuitry 180 for biasing conductive pad 170 provides for the dual function of addressing pixel elements and maintaining the pixel element in a condition to attract electrons for a desired time period, i.e. time-frame or sub-periods of time-frame, as will be explained more fully with regard to FIGS. 2 and 3.

In the embodiment shown in FIG. 1, grid 150 is interposed, relatively equidistant, between cathode 104 and anode 106. Grid 150, having a plurality of grid holes 152, smaller than the cathode-to-anode distance 190, unifies the electron distribution in front of the anode plane. In one aspect, electrons 140 emitted by cathode 104 pass through grid 150 and impinge upon phosphor pad 175 when a corresponding conductive pad 170 is biased to an "on" state. Similarly, electrons are not attracted to the conductive pad 170 when a corresponding conductive pad 170 is biased to an "off" state.

It would be recognized by those skilled in the art that the role of a positively biased grid 150 is advantageous as it serves to unify the electron distribution in front of the phosphor pads. This operation is applicable when the electron energies are small and can be controlled by the potentials applied to the TFT circuitry. For example, when gate voltage for extracting electrons is less than the TFT control voltage, i.e., anode voltage, grid 150 may not be necessary.

However, in another aspect, when the gate voltage for electron extraction from emitter edge 135 is higher than voltage applied to the anode, i.e., phosphor pads 170, via the TFT circuitry, the energies of electron 140 may be too high and not manageable by the relatively low TFT voltages. In this case, grid 150 may be used to decelerate the electrons approaching the phosphor pads by lowering the voltage applied to grid 150.

Although grid 150 is shown in this exemplary embodiment and has been discussed with regard to controlling emitted electrons, it would be recognized that the operation of display 100 is not dependent upon the presence of grid 150 and the embodiment shown in FIG. 1 represents an exemplary embodiment of the invention.

The TFT FED 100 shown allows for a low voltage addressing on the anode and the use of inexpensive LCD drivers. Furthermore, the addressing circuit (not shown) on anode 106 eliminates the need for electron beam focusing methods necessary in conventional FED structures. The use of low voltage further eliminates problems of gas ionization and chamber breakdown characteristically associated with the use of high voltage FEDs. Furthermore, cathode 104 serves as a uniform electron source and provides for high screen brightness and uniformity. The separation of pixel control circuitry from cathode 104 is further advantageous as it makes the fabrication of the device simpler and increases the fabrication yield.

FIG. 2 illustrates a top view of an exemplary TFT-based anode. In this illustrated example, anode 200 is organized in a matrix of electrically conductive rows, referred to as 210, and electrically conductive columns, referred to as 220, electrically insulated from each other. Associated with each row/column is an electrically conductive pad or area 170 and phosphor pad 175 that defines a pixel element. As would be appreciated, phosphor pad 175 predominately covers the conductive area 170 and TFT 180 is thus shown using dashed lines to indicate that it is located beneath phosphor pad 175.

Associated with each conductive pad 170/phosphor pad 175 and accessed by a row/column designation is TFT circuit 180. TFT circuit 180 operates to electrically disconnect an associated conductive pad 170/phosphor pad 175 when the associated pixel is intended to be in an "off" state and connect an associated conductive pad 170/phosphor pad 175 when it is intended to be in an "on" state. A known voltage, referred to as $V_{dd}$, is applied to each TFT circuit 180.

Figure 3:
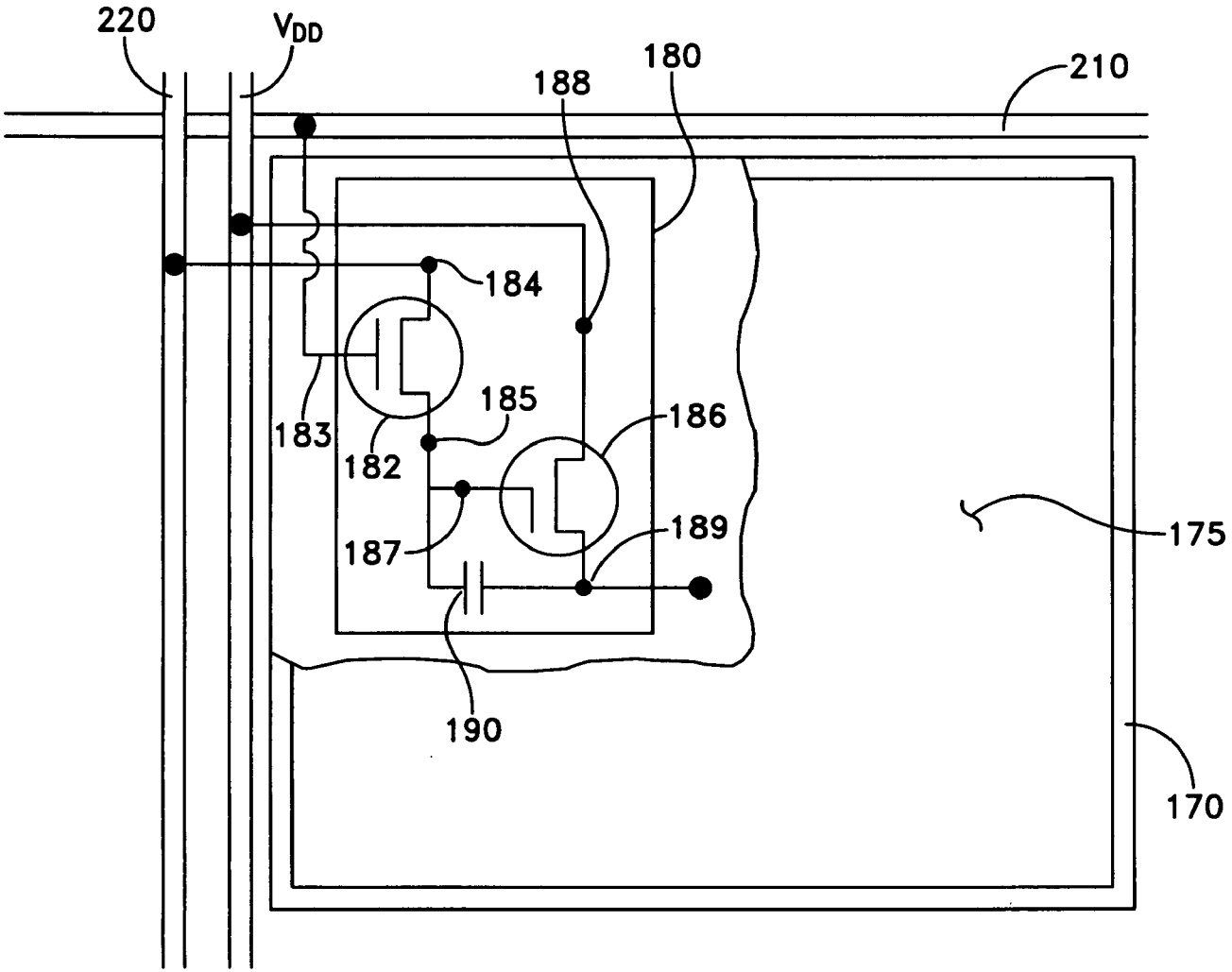
FIG. 3 illustrates a circuit diagram of a TFT circuit used in the present invention.

FIG. 3 illustrates a circuit diagram of 1 TFT circuit 180 associated with a single element in the matrix shown in FIG. 2. In this illustrated embodiment, phosphor pad 1754 is shown cut-away to reveal the details of TFT circuit 180. TFT circuit 180 is composed of two transistor devices 182, 186, electrically cascaded, and capacitor 190 connected between the output of first device 182 and the output of second device 186. In the illustrated embodiment, devices 182, 186 are FETs (Field Effect Transistors). FETs are known in the art to possess a high input impendence.

In the illustrated embodiment, gate node 183 of FET 182 is electrically connected to and associated with row line 210, and node 184 of FET 182 is associated with column line 220. The output node 185 of FET 182 is electrically cascaded to gate electrode 187 of FET 186, and to capacitor 190.

Electrode 188 of FET 186 is electrically connected to constant voltage source, typically $V_{dd}$, and output electrode 189 is electrically connected to electrically conductive pad 170. Capacitor 190 is also further connected between the gate and the source node of FET 186.

In operation, when FET 182 is in an "on" state, by the application of a voltage on row line 210, a voltage applied to column line 220 is passed through FET 182 and concurrently present at, or applied to, gate node 187 of FET 186 and capacitor 190. Capacitor 190 is charged to substantially the same voltage value as applied to column 220. When voltage on row line 210 is removed, capacitor 190 operates to substantially maintain the same potential as is on column line 220 to gate electrode 187. This voltage is maintained for a known period of time, which is based on the value of capacitor 190 and an impedance of FET 182. Capacitor 190 thus operates to substantially "hold" the voltage even after the voltage or potential to selected row 210 is removed.

As voltage or potential is applied to gate terminal 187 of FET 186, FET 186 is in an "on" state and the constant, fixed voltage or potential, $V_{dd}$, applied to node 188, which is also referred to as an anode voltage ($V_a$), is passed through FET 186 to node 189 and associated pad 170. Pad 170 then is operable to attract electrons 140 (not shown) drawn from cathode 104. When the gate electrode 187 voltage is removed, the corresponding pixel is switched to an "off" state as the potential at electrode 189 is relatively low, i.e., near zero volts. In one aspect of the invention, the anode voltage may be in the range of about 20–30 volts.

Thus, TFT circuit 180 provides for both "pixel selection" and "pixel hold" functions. Accordingly, electrons 140 may continue to be attracted to the corresponding phosphor layer 175 for a desired time frame without the concurrent application of a voltage on a corresponding row line.

Capacitor 190 is sized to be commensurate with the desired frame time and the input impedance of the second active device 186. The value of capacitor 190 may be selected such that the decay of the stored charge through the impedance of first device 182 is in the order of or larger than the desired frame time.

Figure 4:
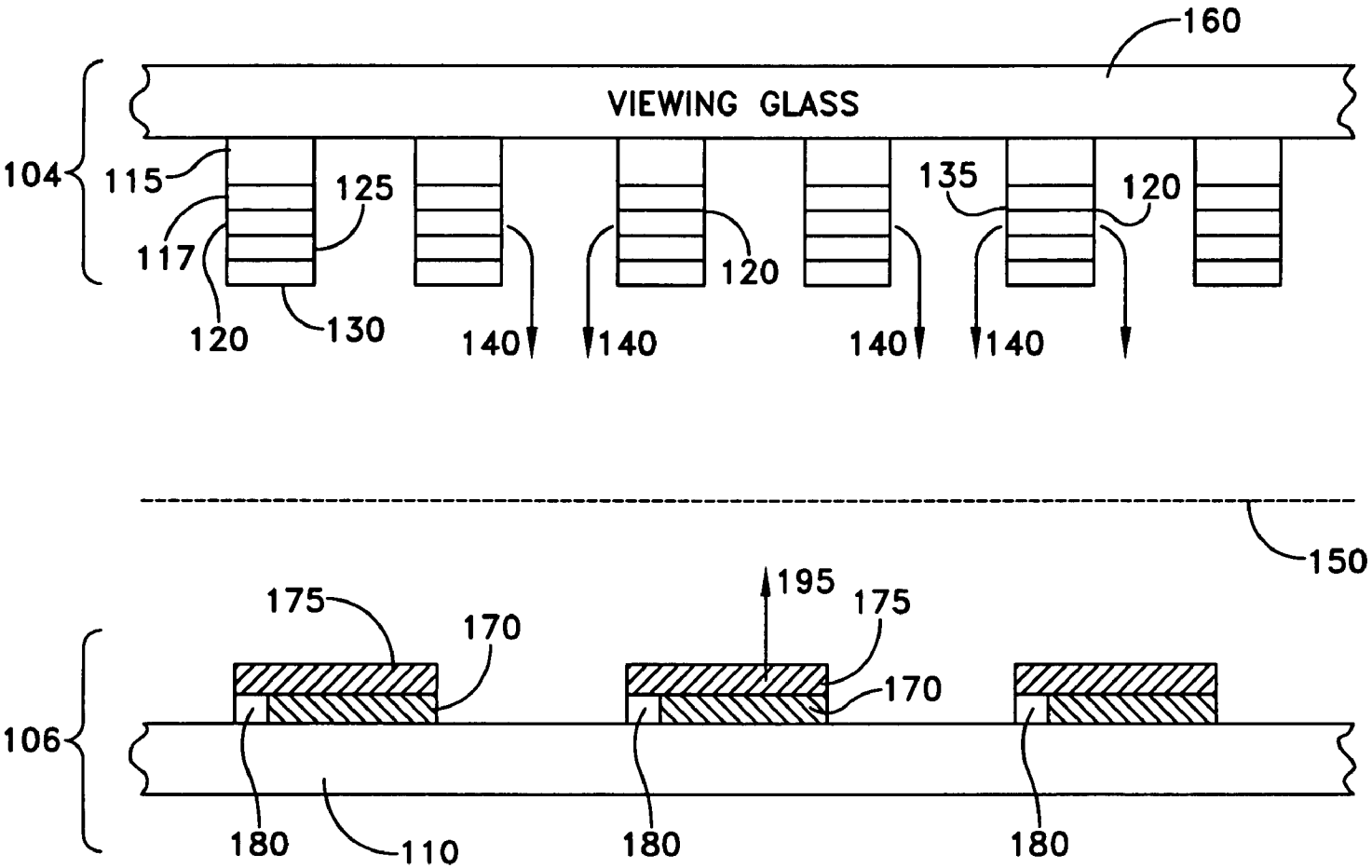
FIG. 4 illustrates a cross-sectional view of a second embodiment of a TFT anode-based FED in accordance with the principles of the present invention.

Returning to FIG. 2, although the exemplary display matrix has been described as a monochromatic display having six pixel elements, those skilled in the art should readily recognize that FIG. 2 may also represent a color display having three color pixels with each color pixel having associated red, green and blue phosphor layers. While the present color display is described with the use of conventional RGB (red, green, blue) technology, the use of phosphor layers that emit light of alternate colors, visible and non-visible, is considered within the scope of the inventions FIG. 4 illustrates a second embodiment of the display. In this embodiment, the TFT anode structure shown in FIG. 2 is deposited on substrate 110. In this case, a material such as poly-silicon or amorphone silicon, may be deposited on substrate 110, that allows for the fabrication of row lines 210 (not shown), column lines 220 (not shown), conductive pad 170 and TFT circuit 180 onto substrate 110 in row/column matrix as shown in FIG. 2. Phosphor layer 175 may then be deposited on corresponding conductive pads 170.

In one aspect a silicon (Si) single crystal wafer may be used for the active matrix circuitry, wherein the Si wafer is attached to a glass substrate. In this case, the phosphor pads are also made on the Si wafer.

Cathode 104 is fabricated on viewing surface 160 and emitter layer 120 and conductive layer 130 operate to draw electrons from edges 135 of emitter layer 120. Emitter layer 120 and conductive layer 130 occupy a significantly small portion of the viewing glass area to allow for photons to be viewed through cathode 104 and transparent viewing glass 160. As would be appreciated, elements of cathode 104 may be composed of optically transparent materials.

As in the embodiment shown in FIG. 1, grid 150 may have a dual function in both unifying the electron distribution approaching the phosphor pads and decelerating the electron. This latter function may be needed when the threshold voltage for electron extraction from the emitter edge is too high to be controlled by the voltages on the TFT circuit.

Figure 5:
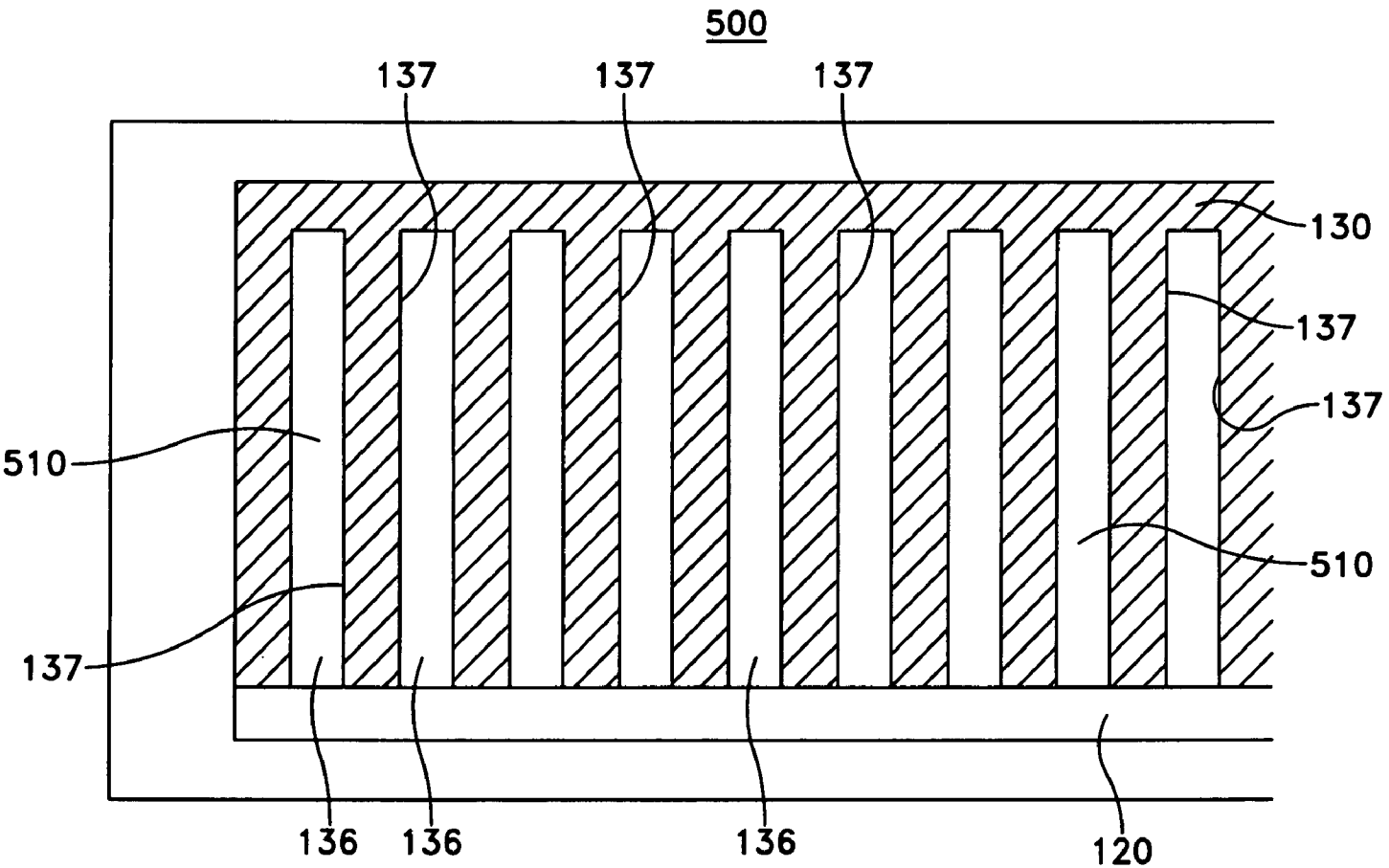
FIG. 5 illustrates a top view of an exemplary FED cathode in accordance with the principles of the present invention.

FIG. 5 illustrates a top view of an exemplary cathode 104 in accordance with the principles of the invention. It is desired that cathode 104 serves as a uniform electron source when the voltage applied to conductive layer 130 is sufficiently positive relative to emitter layer 120. In this exemplary embodiment, wells 136 are formed within the conductive layer 130 as elongated slots 510, which increase the length of emitter edges 135 (not shown). Increased emitter edge 135 length provides for an increased edge area for the emission of electrons 140.

In this exemplary view, wells 136 are etched through conductive layer 130 to expose the emitter layer edges. Edges 135 (not shown) of emitter layer 120 are formed beneath edges 137 of conductive layer 130.

Figure 6:
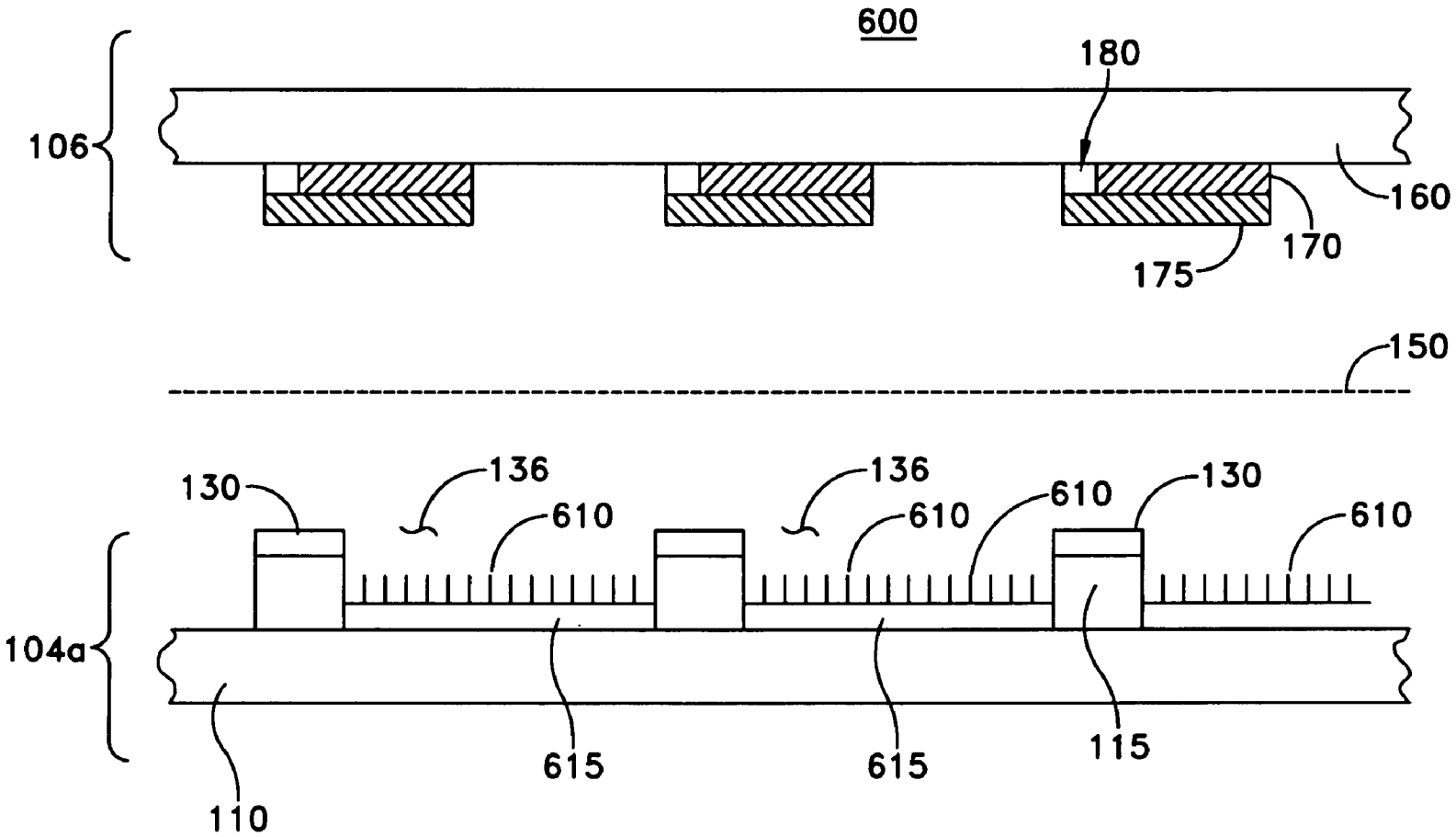
FIG. 6 illustrates a cross-section view of another embodiment of the TFT based display shown in FIG. 1 using an alternate cold cathode configuration.

FIG. 6 illustrates another exemplary embodiment of a TFT based display 600 wherein cathode 104*a* is composed of a plurality of carbon nanotubes 610 placed on conductive material 615 located within well 136. In this case, conductive layer 130, electrically isolated from material 615, operates as a gate that may be used to draw electrons 140 from nanotubes 610, when the potential difference between gate 130 and nanotube 610 exceeds a threshold for electron extraction. Nanotubes 610 are known to possess extremely low threshold voltages in the order of 1–3 V/micron for electron emission. Cataphoretic deposition or printing of nanotubes 610, as well as nanotube growth on a metal surface are known in the art.

Similar to the design shown in FIG. 1, grid 150 is also shown in this exemplary embodiment to control and decelerate, if necessary, the flow of electrons 140 directed toward phosphor layer 175. Anode 106 is similar to that described with regard to FIG. 1 and its description need not be repeated.

Figure 7:
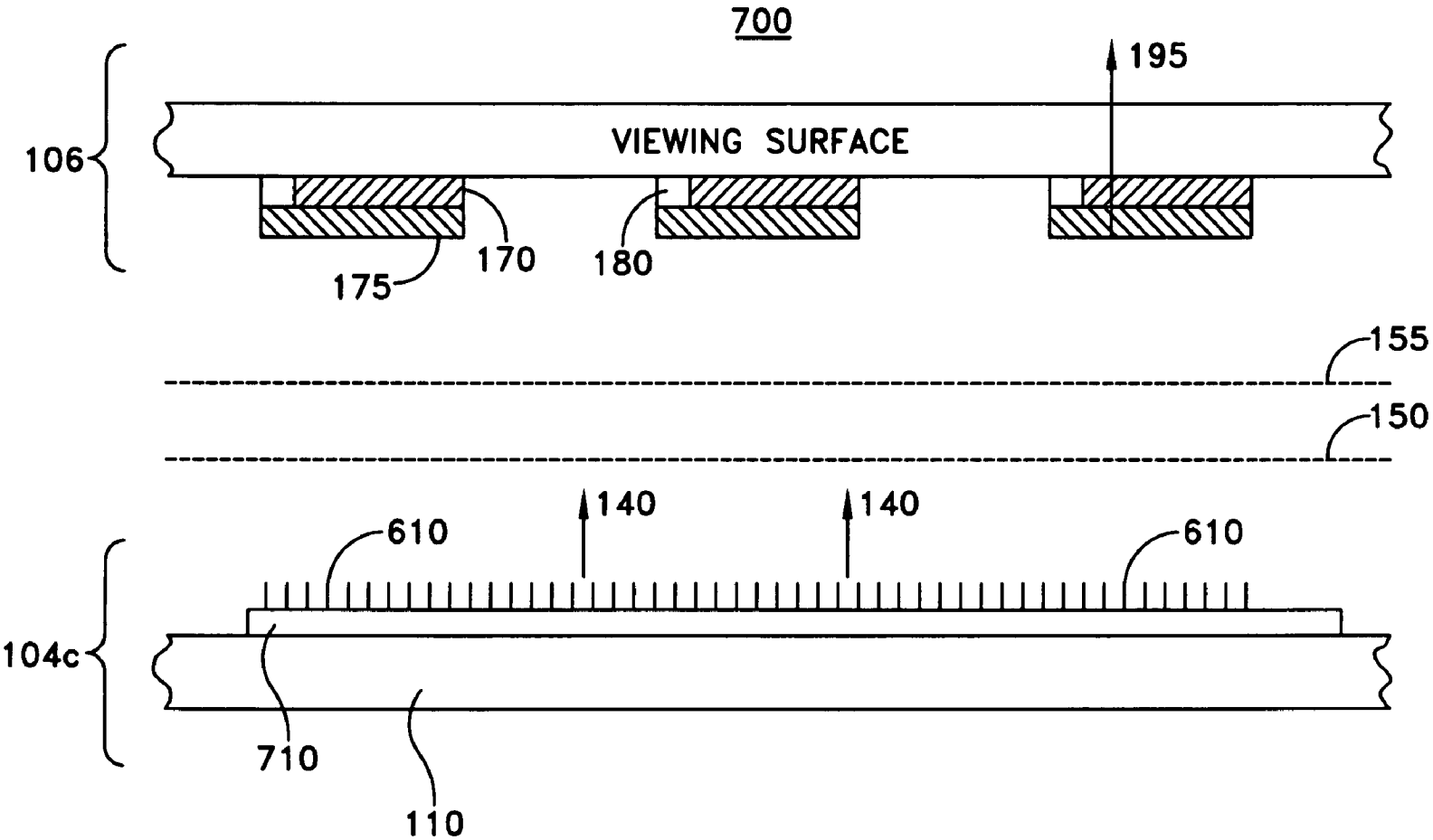
FIG. 7 illustrates a cross-sectional view of another embodiment of the TFT based display shown in FIG. 4 using an alternate cold cathode configuration.

FIG. 7 illustrates another exemplary embodiment of a TFT-cold cathode based display 700, wherein cathode 104*c* is composed of a plurality of carbon nanotubes 610 that are uniformly distributed on a conductive layer 710 on substrate 110. Grid 150 is also shown in this embodiment and is used for extracting electrons 140 emitted by nanotubes 610 and directed toward phosphor layer 175. In this embodiment, second grid 155 is included to decelerate electrons so that they are controllable by the TFT circuitry. Anode 106 is similar to that described with regard to FIG. 1 and its description need not be repeated.

Figure 8:
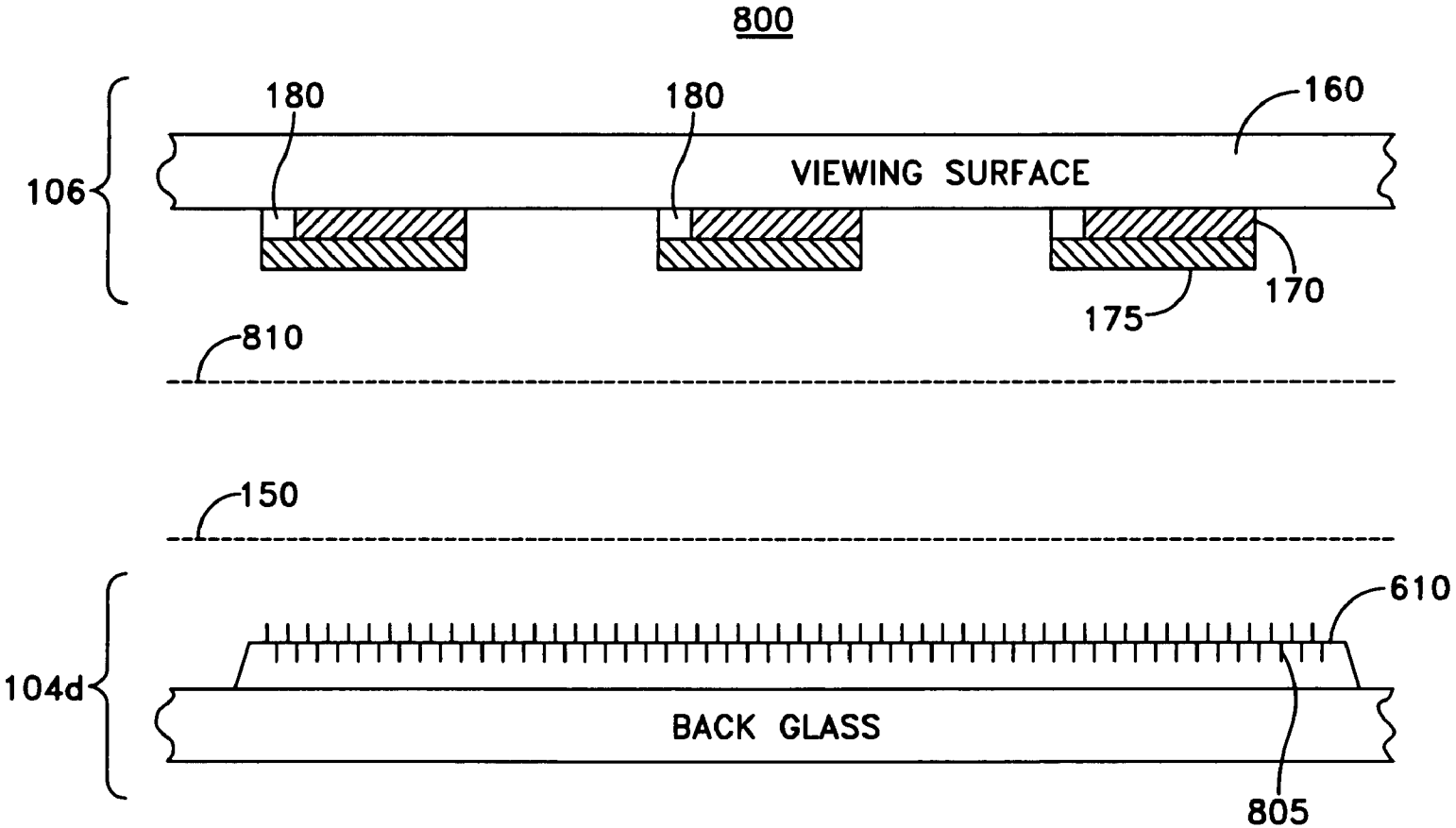
FIG. 8 illustrates a cross-sectional view of another embodiment of a TFT-cold cathode based display.

FIG. 8 illustrates an embodiment of a TFT-cold cathode based display 800 constructed similar to the display shown in FIG. 1, i.e., anode on viewing surface. In this embodiment, cathode 104*d* is composed of nanotubes 610 deposited on cathode filament 805. In this case, electrons 140 are emitted from nanotubes 610 when a voltage difference between grid 150 and cathode filament 805 is sufficient to extract electrons 140. Grid 150 is located in the range of 100–200 microns above substrate 110. Second grid 810, which is used to decelerate electrons 140, is located between grid 150 and anode 106. Anode 106 is similar to that described with regard to FIG. 1 and its description need not be repeated.

Figure 9:
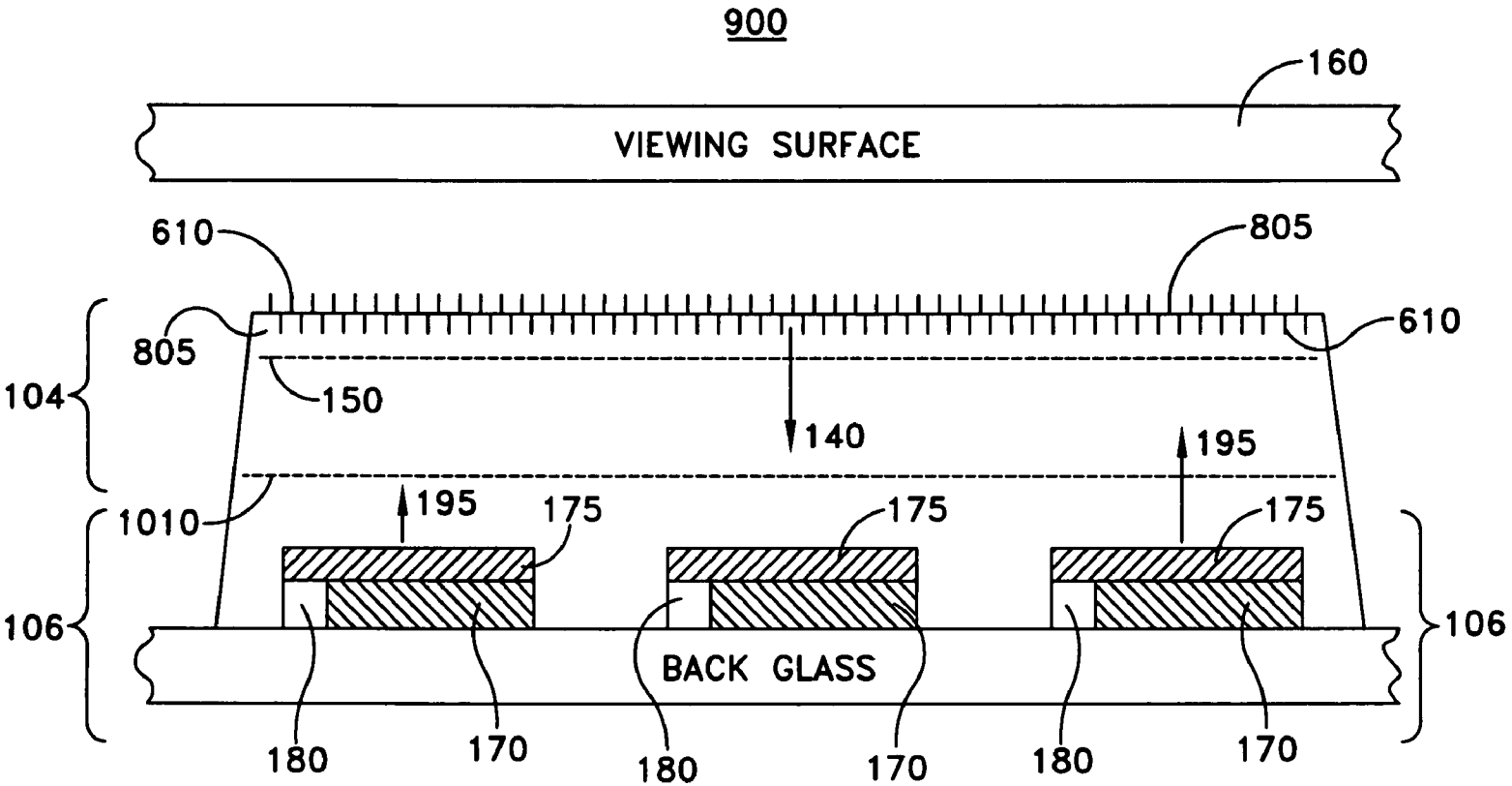
FIG. 9 illustrates a cross-sectional view of another embodiment of a TFT-cold cathode based display.

FIG. 9 illustrates another exemplary embodiment of a TFT-cold cathode based display 900 constructed similar to the display shown in FIG. 4, i.e., anode on back surface. In this embodiment, cathode 104 is composed of nanotubes 610 on cathode filament 805 as previously described, and grids 150 and 810 are installed between nanotubes 610 and anode 106, to control and decelerate the flow of electrons to anode 106. Anode 106 is similar to that described with regard to FIG. 4 and its description need not be repeated.

Figure 10:
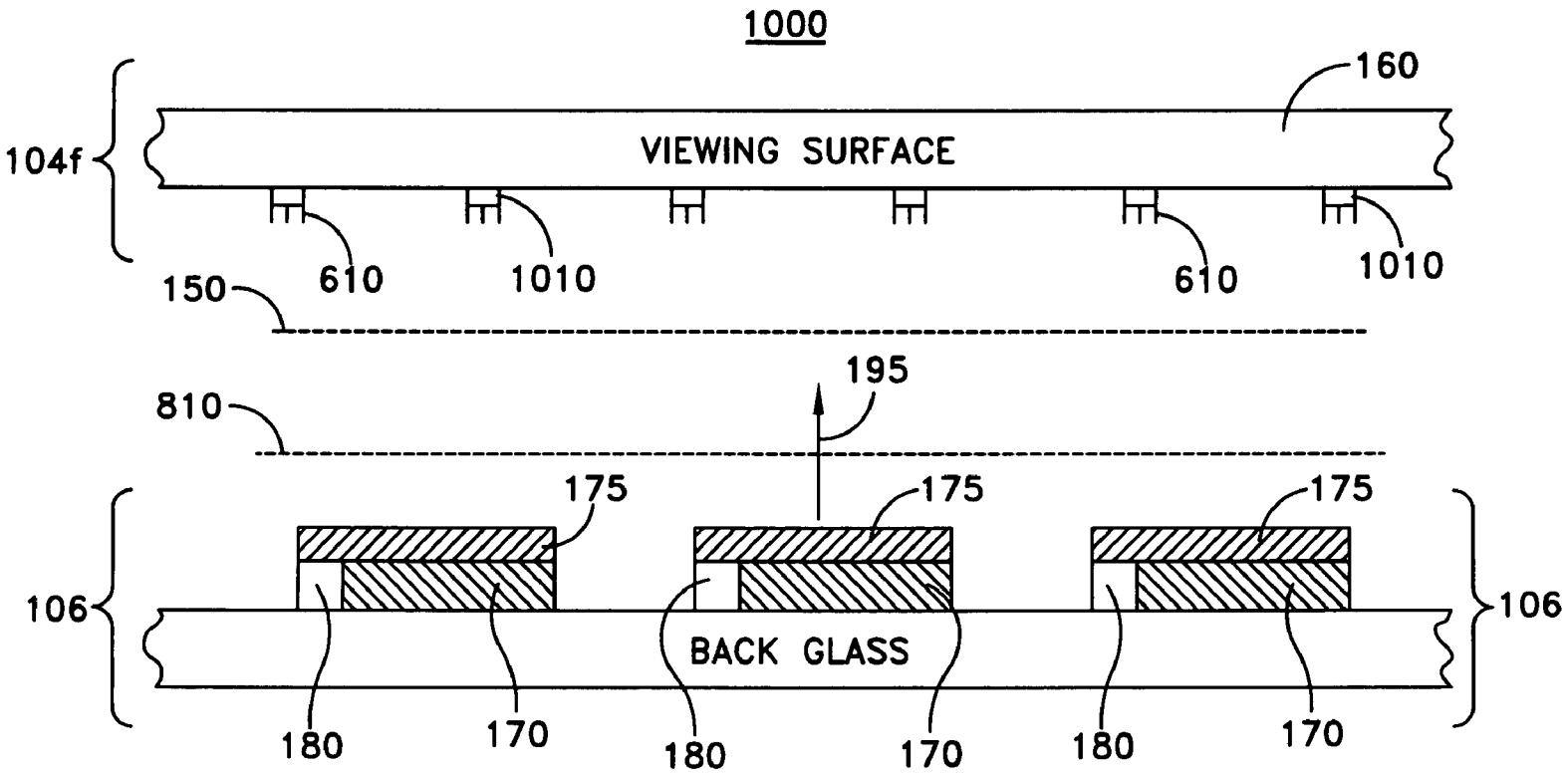
FIG. 10 illustrates a cross-sectional view of another embodiment of a TFT-cold cathode based display.

FIG. 10 illustrates an embodiment of a TFT-cold cathode based display 1000 constructed similar to the display shown in FIG. 4, i.e., anode on back surface. In this case, cathode 104*f* is composed of nanotubes 610 on narrow stripes of conductive layer 1010. The area occupied by these stripes is small and does not affect the image quality. Grids 150 and 810 are installed between cathode 104*f* and anode 106 to extract and control the flow of electrons 140 to anode 106. Grid 810 is used to decelerate the flow of electrons when the electron energies are too high to be controlled by the low anode voltage of the TFT circuit 180. Anode 106 is similar to that described with regard to FIG. 4 and its description need not be repeated.

Although not shown or discussed in detail, it would be understood by those skilled in the art that insulating spacers may be distributed throughout the display to electrically isolate the electrical potential applied to the elements disclosed, to separate two plates from each other and to sustain the evacuated pressure. It should be further understood that the spacers may be used to reduce glass plate thickness and thus decrease both weight and thickness of the display. It should also be understood that the edges of the overall display may be sealed and that the space between the cathode and the anode may be evacuated to a level of at least $10^{-5}$ tor.

While there has been shown, described, and pointed out fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A flat panel display arranged in a matrix of N rows and M columns comprising:

a first surface containing an anode thereon, said anode comprising:

a plurality of electrically conductive areas each associated with a row (N) and a column (M) defining a pixel location;

a phosphor layer associated with each of said areas;

a TFT circuit operable to apply a predetermined voltage to an associated one of the conductive areas, said TFT circuit, comprising:

first and second electrically cascaded transistors; and a capacitor electrically connected between an output of said first transistor and an output of said second transistor, wherein the capacitor and output of the second transistor are electrically coupled to the associated conductive area; and a cold cathode, deposited on a second surface, facing said first surface, comprising:

a conducting layer disposed on said second surface; and an emitter material disposed on said conducting layer operable to emit electrons when an associated threshold voltage is exceeded.

2. The display as recited in claim 1, further comprising: a grid interposed between said anode and said cathode.

3. The display as recited in claim 2, wherein said cathode further comprises a second conducting layer electrically isolated from said emitter material, said second conductive layer operating as a gate to extract electrons from the emitter material when a potential difference between said second conductive layer and emitter material exceeds said threshold voltage.

4. The display as recited in claim 2 wherein a potential difference between said grid and said conducting layer exceeds said threshold voltage.

5. The display as recited in claim 3, wherein a potential applied to said first grid is less than a potential difference between said conducting layer and said second conductive layer.

6. The display as recited in claim 2, further comprising: a second grid interposed between said grid and said anode.

7. The display as recited in claim 6, wherein said second grid potential is less than said grid potential.

8. The display as recited in claim 1, wherein said first surface is optically transparent.

9. The display as recited in claim 1, wherein said conductive areas are optically transparent.

10. The display as recited in claim 1, wherein said second surface is optically transparent.

11. The display as recited in claim 1, wherein said second surface is selected from the group consisting of: silicon, poly-silicon, amorphous silicon.

12. The display as recited in claim 1, wherein said emitter material is distributed throughout said cathode, wherein electrons are emitted from an edge of said emitter material.

13. The display as recited in claim 1, wherein said emitter material is an alpha-carbon.

14. The display as recited in claim 1, wherein said emitter material is composed of a plurality of carbon nanotubes.

15. The display as recited in claim 1, wherein said conducting layer is substantially optically transparent.

16. The display as recited in claim 1, wherein said predetermined voltage is in the range of 20–30 volts.

17. The display as recited in claim 1, further comprising: a plurality of spacers electrically isolating said anode and said cathode.

18. The display as recited in claim 17, wherein a space between said first surface and said cathode is evacuated.

19. The display as recited in claim 1, wherein said phosphor layer material is operable to emit photons of a known wavelength.

20. The display as recited in claim 1, wherein said phosphor material is operable to emit photons having a color selected from the group consisting of: red, green, blue.

21. The display as recited in claim 1, further comprising: means to selectively apply a first potential to each of said N rows; means to selectively apply a second potential to each of said M columns.

22. The display as recited in claim 1, wherein said first input of said first device is in electrical communication with one of said N rows, said second input of said first device in electrical communication with one of said M columns, said output of said second device in electrical communication with said associated area.

23. A display comprising:

an anode deposited on a first surface arranged in a matrix of N rows and M columns comprising:

a plurality of electrically conductive areas;

a phosphor layer associated with each of said areas;

a TFT circuit operable to apply a predetermined voltage to an associated area, said TFT circuit, comprising:

first and second electrically cascaded transistors; and a capacitor electrically connected between an output of said first transistor and an output of said second transistor, wherein the capacitor and output of the second transistor are electrically coupled to the associated conductive area;

a first grid;

a cold cathode facing said anode deposited on a second surface, said cold cathode comprising:

an emitter material operable to emit electrons when a threshold voltage is exceeded; and a conducting layer underneath said emitter material deposited on said second surface;

a plurality of spaces electrically isolating said anode, first grid and cold cathode, wherein a vacuum is within said space.

24. The display as recited in claim 23, further comprising: means to apply a potential to said first grid, wherein a potential difference between said first grid potential and a conducting layer potential exceeds said threshold voltage.

25. The display as recited in claim 23, wherein said cathode further comprises: a second conducting layer electrically isolated from said emitter material.

26. The display as recited in claim 25, further comprising: means to apply a potential to said second conducting layer, wherein a potential difference between said second conducting layer potential and the conducting layer potential exceeds said threshold voltage.

27. The display as recited in claim 25, wherein said first grid potential is less than said second conducting layer potential.

28. The display as recited in claim 23, further comprising: a second grid, positioned between said first grid and said anode.

29. The display as recited in claim 28, further comprising: means to apply a potential to said second grid wherein said potential is less than said first grid potential.

30. The display as recited in claim 23, wherein said predetermined voltage is in the range of 20–30 volts.

31. The display recited in claim 23, wherein said emitter material is distributed throughout said cathode.

32. The display recited in claim 23, wherein said emitter material is composed of a plurally of carbon nanotube.

33. The display as recited in claim 23, wherein said emitter material is an alpha-carbon having an edge.

34. The display as recited in claim 23, further comprising: means to selectively apply a first potential to each of said N rows; and means to selectively apply a second potential to each of said M columns.

35. The display as recited in claim 23, wherein said first surface is optically transparent.

36. The display as recited in claim 23, wherein said second surface is optically transparent.

37. The display as recited in claim 27, wherein said cathode is positioned between said anode and an optically transparent surface.

38. A flat panel display having an anode and a cathode, said display arranged in a matrix of N rows and M columns, wherein the intersection of a row and column constitutes a pixel, in combination therewith the improvement comprising:

a cold cathode for emitting electrons to be directed to said anode, and a TFT circuit for each pixel, said circuit employing first and second active devices in cascade and each coupled between an associated row (N) and column (M) to define a pixel at said location M and N and when activated operative to attract said emitted electrons to said pixel location;

wherein each said TFT circuit comprises: first and second electrically cascaded transistors; and a capacitor electrically connected between an output of said first transistor and an output of said second transistor, and the capacitor and output of the second transistor are electrically coupled to the associated pixel.

* * * * *